US007134287B2

(12) United States Patent
Belsom et al.

(10) Patent No.: US 7,134,287 B2
(45) Date of Patent: Nov. 14, 2006

(54) TURBINE COMBUSTOR ENDCOVER ASSEMBLY

(75) Inventors: Keith Cletus Belsom, Laurens, SC (US); Larry Lou Thomas, Flat Rock, NC (US); Donald Timothy Lemon, Greenville, SC (US); Bradley Donald Crawley, Simpsonville, SC (US); Matthew Eugene Roberts, Mauldin, SC (US); David Kevin Spikings, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 669 days.

(21) Appl. No.: 10/615,776

(22) Filed: Jul. 10, 2003

(65) Prior Publication Data

US 2005/0005610 A1 Jan. 13, 2005

(51) Int. Cl.
*F02C 7/20* (2006.01)

(52) U.S. Cl. ..... 60/800; 60/796; 277/641

(58) Field of Classification Search ..... 60/796, 60/800, 740, 752
See application file for complete search history.

(56) References Cited

U.S. PATENT DOCUMENTS 3,012,802 A * 12/1961 Waite ..... 277/608
3,827,701 A * 8/1974 Sakamaki ..... 277/357
3,869,132 A * 3/1975 Taylor et al. ..... 277/608
4,121,843 A * 10/1978 Halling ..... 277/647
5,121,597 A * 6/1992 Urushidani et al. ..... 60/778
5,265,412 A * 11/1993 Bagepalli et al. ..... 60/800
5,697,651 A * 12/1997 Fernandes ..... 285/94
5,730,445 A * 3/1998 Swensen et al. ..... 277/647
6,199,871 B1 * 3/2001 Lampes ..... 277/614
6,237,921 B1 * 5/2001 Liotta et al. ..... 277/630
6,299,178 B1 * 10/2001 Halling ..... 277/654
6,752,592 B1 * 6/2004 Mohammed-Fakir et al. ..... 415/139

* cited by examiner

*Primary Examiner*—William H. Rodrīguez
(74) *Attorney, Agent, or Firm*—Nixon & Vanderhye, PC

(57) ABSTRACT

The endcover assembly for a combustor includes an endcover having an aperture, an insert disposed in the stepped bore opening through an internal face of the endcover, a fuel cartridge extending through the insert and aperture and a seal cover on the external face of the endcover. Seal cover/endcover annular seals are disposed in registering axial cavities to seal against fluid leakage externally of the endcover assembly. Generally C-shaped and W-shaped seals are disposed in the cavities between the stepped shoulders of the insert and aperture to seal against leakage through the internal face of the endcover. The seals maintain sealing engagement during assembly and thermal distortion during turbine usage.

17 Claims, 5 Drawing Sheets

TURBINE COMBUSTOR ENDCOVER ASSEMBLY

BACKGROUND OF THE INVENTION

The present invention relates to a turbine combustor endcover assembly employing seals between the endcover and endcover inserts and fuel nozzle cartridge to define seal boundaries with respect to purge air and fuel flow passages internal to the endcover assembly and accommodate thermal deflection of the various parts forming the endcover assembly.

As common in gas turbines, a plurality of combustors are arranged in an annular array about the turbine to provide for the combustion of fuel and guide the energized combustion products into the turbine section to drive the turbine. Each combustor typically includes an outer casing which defines the external boundary of the combustor, a flow sleeve for distributing compressor discharge air to the head of the combustion system while cooling a liner which encloses the combustion process and a transition piece for flowing the combustion products into the turbine section. The combustor also includes a plurality of fuel nozzles coupled to an endcover. Air and fuel is supplied through the endcover to the fuel nozzles for combustion within the liner. The endcover thus functions to distribute air and fuel to the fuel nozzles.

Endcover designs for turbine combustor systems typically have included a flat plate mounting the fuel nozzle to an endcover. In this early endcover assembly, the internal passages for the air and fuel were located in the fuel nozzle separate and apart from the endcover. A follow-on generation of endcovers used in gas turbines provided air and fuel passages internal to the endcover. This was done to accommodate a plurality of nozzles for each endcover rather than one fuel nozzle per endcover as in prior conventional combustors. While that change simplified the fuel nozzles and enabled the mounting of a plurality of fuel nozzles onto the endcover, the complexity of the endcover was increased to provide the air and fuel manifolds and necessary multiple passages internal to the endcover for the fuel nozzles carried thereby. Extra parts were necessary, such as inserts, to render complex passages in the endcovers possible. Brazed joints were also included to seal such extra parts, including inserts in the endcovers. A further generation of endcovers for turbine combustors followed. These employed even more complicated brazed joints between the endcovers and its various parts. However, cracking of the brazed joints was observed on these follow-on endcovers.

Upon analysis, the cracking appeared to be the result of high brazed joint strains which, in turn, resulted from both the complex passage geometry within the endcover and thermal gradients across the brazed joints. For example, as explained below and illustrated in FIG. 2, the endcover included a plurality of fuel nozzles bolted thereto with the various fuel and air passages of the nozzles lying in communication with air and fuel passages formed by manifolds in the endcover. Particularly, an insert was provided in an aperture opening between opposite sides of the endcover and which insert in part defined the fuel and air passages from the manifolds in the endcover to the fuel nozzles. Cracks were experienced between the brazed joints of the inserts and the endcover defining the fuel and air passages, as well as between the fuel cartridge and cover flange along the external surface of the endcover. Accordingly, there is a need for an endcover assembly having internal fuel and air manifolds for connection with fuel and air passages in inserts and fuel cartridges which avoids the problem of cracking of brazed joints between the parts forming the endcover assembly.

BRIEF DESCRIPTION OF THE INVENTION

In accordance with a preferred embodiment of the present invention, there is provided an endcover assembly which employs seals instead of brazed joints between inserts in the endcover assembly to seal the boundaries of the manifolds and respective fuel and air passages internal to the endcover and inserts. The seals are employed to preclude fluid leakage, both externally and internally of the endcover assembly. In a preferred form hereof, the nozzle cartridge extends through an aperture in the endcover to terminate adjacent the outer surface of the endcover. A flange is bolted to the outer surface of the endcover and a seal is employed between the endcover outer surface and the flange. Particularly, the seal preferably comprises in this cartridge/seal region a spring-energized metal C-shaped seal disposed in a groove machined into the nozzle cover. The C-shaped seal forms the primary seal for the bolted joint. Further, the sealing effect is also enhanced by providing a relief cut adjacent the outer perimeter of the flange. This cut creates a circular zone about the flange which mates with a spot face machined into the nozzle and cover. This affords a secondary sealing capacity at this particular joint. A still further enhancement at this joint is the provision of a cylindrical projection forming a positioning projection for mating with a counterbore in the endcover. This extension and counterbore relation restricts fluid flow to the primary seal location and affords further protection against leakage. The positioning of the extension in the counterbore also prevents introduction of debris into the flowpath in the event of a seal breakdown. This positioning feature also restricts lateral movement of the flange with respect to the endcover, thereby preventing excessive wear between the primary sealing surfaces and the seal. It will be appreciated that this seal can be retrofitted to existing in-service endcovers when provided as original equipment manufacture.

The insert and seal region along the inside face of the endcover is also provided with a series of mechanical seals. The endcover is provided with a stepped bore which receives the insert in a manner defining the fuel and air passages through the endcover. For example, annular metal ring seals having a generally W-shaped cross-section with high spring-back capability are employed in joints between the insert and the endcover stepped bore that experience significant cavity depth change due to thermal expansion and contraction. A different metallic spring, for example, an annular spring having a generally C-shaped cross-sectional configuration is used at the interior end of the assembly to maximize sealing in an area which is minimally impacted by thermal effects. It will be appreciated that the insert/endcover assembly distributes the appropriate fluid, i.e., air or fuel, from the manifolds of the endcover to the individual fuel nozzle passages via mating passages in the insert.

As the insert is assembled into the stepped bore of the cover, seal cavities are formed between axially registering shoulders or cuts in the endcover bore and insert. The seals are then biased or crushed as the insert is fastened to the cover using screws. The particular spring seals reflect the need to maintain specific seal cavity depths through all modes of turbine operation. The requirement is to set the axial deflection/crush of the seal sufficiently to ensure both sealing and avoidance of seal over-strain during assembly and operation. Further, all edges of the seal shoulders or cuts are chamfered and the seal cavities include radiused cuts. Cavity widths are also designed to include a gap between the insert body and the seal internal diameter and a gap between the cover and seal outside diameter. These insert and endcover dimensions are sized to prevent insert binding during assembly. A specific advantage of the present invention is improved maintenance compared with the prior brazed endcover assemblies. By using seals instead of brazed joints, the insert can be removed for maintenance simply by removing the screws. When using brazed endcover inserts, however, they need to be machined-out if insert removal is required for maintenance.

In a preferred embodiment according to the present invention, there is provided an endcover assembly for a combustor of a turbine comprising an endcover having an aperture opening through opposite internal and external end faces thereof, a seal cover secured to the endcover overlying the aperture opening through the external end face of the endcover, a fuel assembly secured to and projecting internally from the endcover, the fuel assembly including a structure defining a purge passage extending in the aperture, a seal between the seal cover and the endcover to preclude fluid leakage externally of the endcover assembly from the external face thereof, the aid seal including an annular spring generally C-shaped in cross-section having opposite edges biased to engage the seal cover and a seat forming part of the endcover.

In a further preferred embodiment according to the present invention, there is provided an endcover assembly for a combustor of a turbine comprising an endcover having a stepped bore opening through an internal, axially facing, end face thereof and having a first axially facing shoulder, the endcover including a plurality of manifolds for conveying fluids, a stepped insert disposed in the stepped bore and having a second shoulder facing in an opposite axial direction and in registration with the first shoulder of the endcover, the insert having passages in communication with the manifolds, respectively, a seal between the endcover and the insert including at least one annular spring having axially spaced legs engageable against the registering shoulders of the endcover and the insert to seal against internal fluid leakage between the endcover and the insert and a fuel nozzle secured to the endcover and having passageways in communication with the fluid passages, respectively, in the insert.

DETAILED DESCRIPTION OF THE INVENTION

Figure 1:
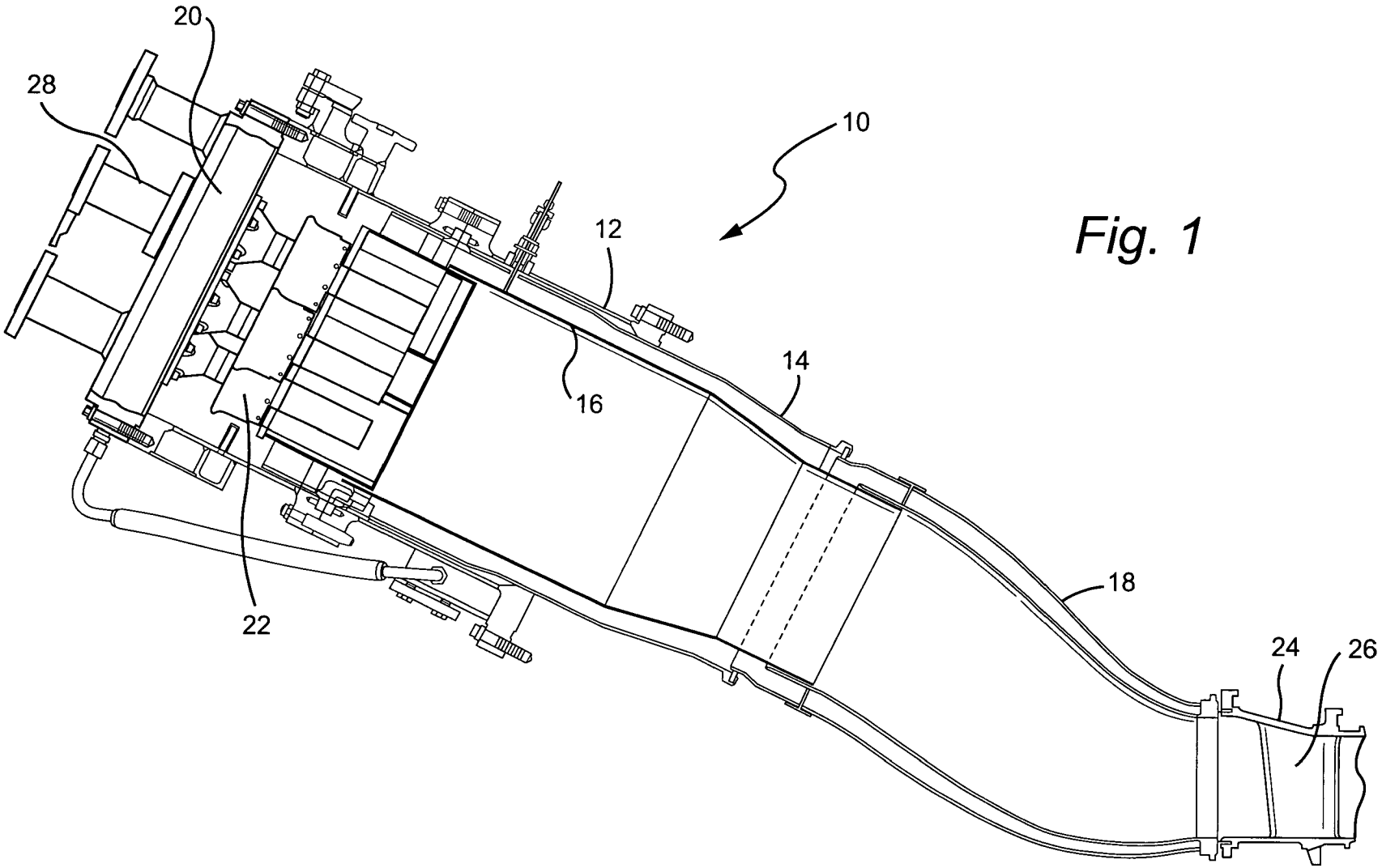
FIG. 1 is a schematic illustration of a combustor for a turbine employing seals according to the present invention.
Figure 3:
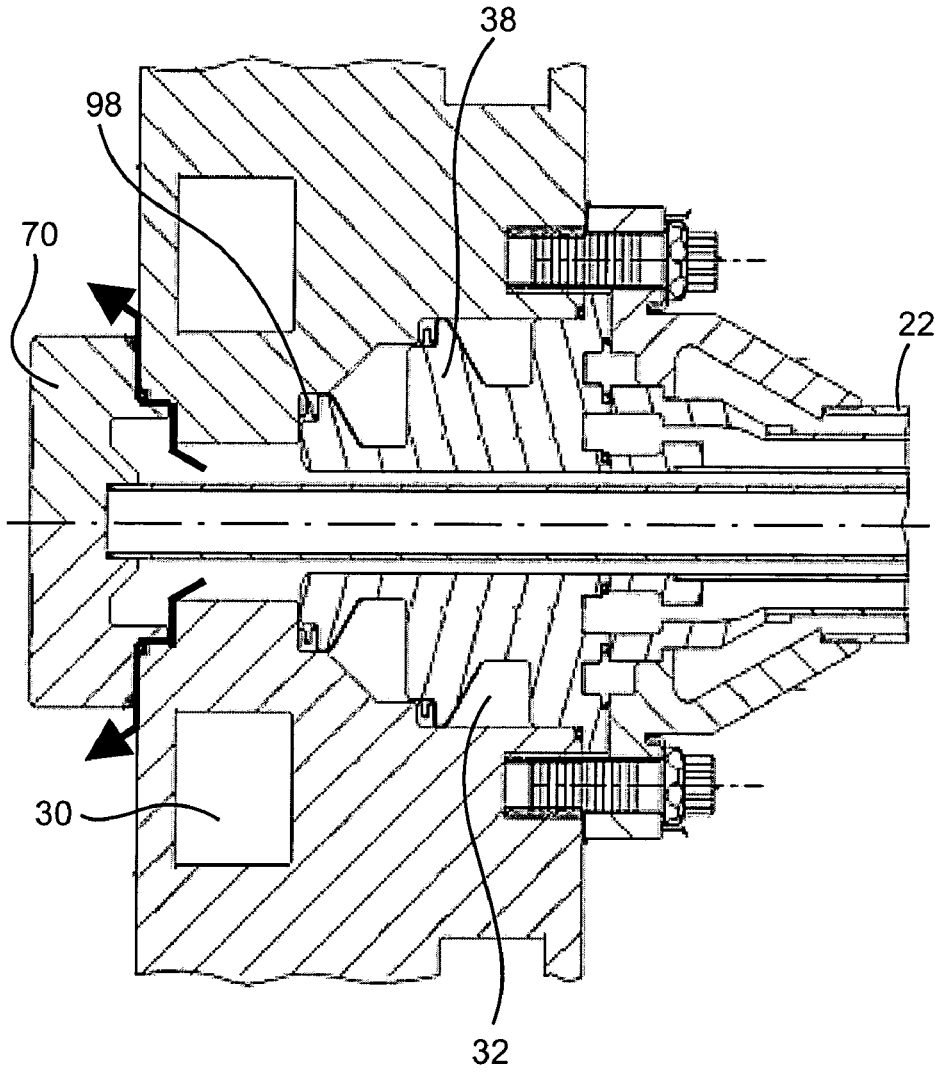
FIG. 3 is a fragmentary cross-sectional view of an endcover employing seals in accordance with a preferred embodiment of the present invention.
Figure 4:
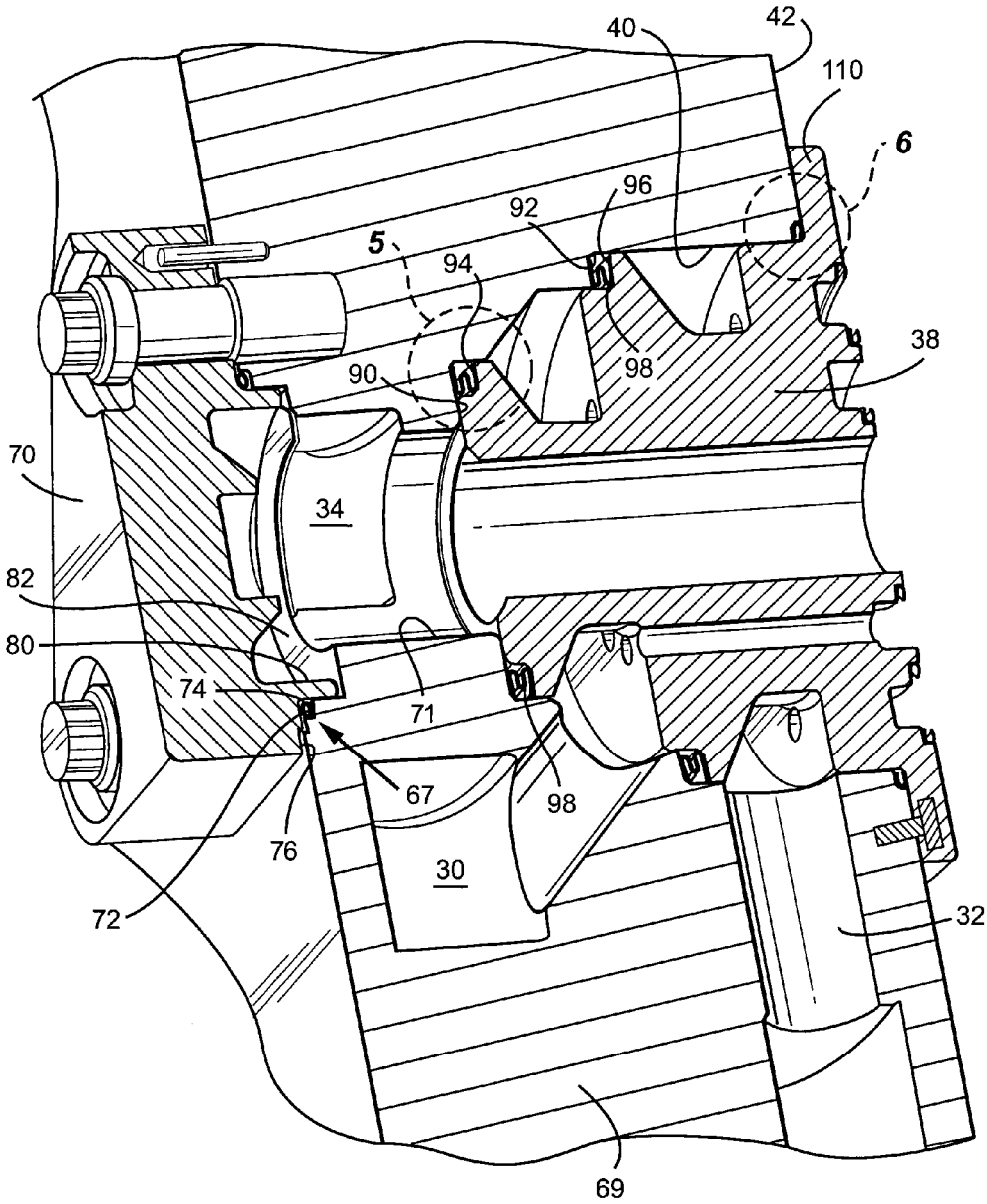
FIG. 4 is an enlarged fragmentary perspective view illustrating an endcover with attached insert and fuel cartridge using seals of the present invention.

Referring now to the drawings, particularly to FIG. 1, there is illustrated a combustor employing an endcover assembly in accordance with a preferred embodiment of the present invention. The combustor, generally designated 10, includes an outer casing 12, a flow sleeve 14, a liner 16, a transition piece 18, an endcover 20 and a plurality of fuel nozzles 22. As typical in combustors, the flow sleeve 14 distributes compressor discharge air to the combustor, while cooling the liner 16. The endcover 20 encloses the head of the combustor, supplies purge air and fuel to the fuel nozzles 22 and forces air into the head end of the liner by way of the fuel nozzle bodies. The liner 16 provides an enclosure for the combustion process, while the transition piece 18 guides the products of combustion into the turbine section 24, the first stator blade of which is illustrated at 26. External plumbing connections 28 are provided on the endcover assembly 20 for supplying air and fuel to the nozzles 22. As illustrated in FIGS. 3 and 4, manifolds 30, 32 and 34 are provided in the endcover assembly for routing air and fuel to five inserts 38 secured in stepped bores 40 of the endcover opening through the inner face 42 thereof. The inserts mate with respective nozzles 22 and thus supply air and fuel to the fuel nozzles that are bolted to the endcover.

Figure 2:
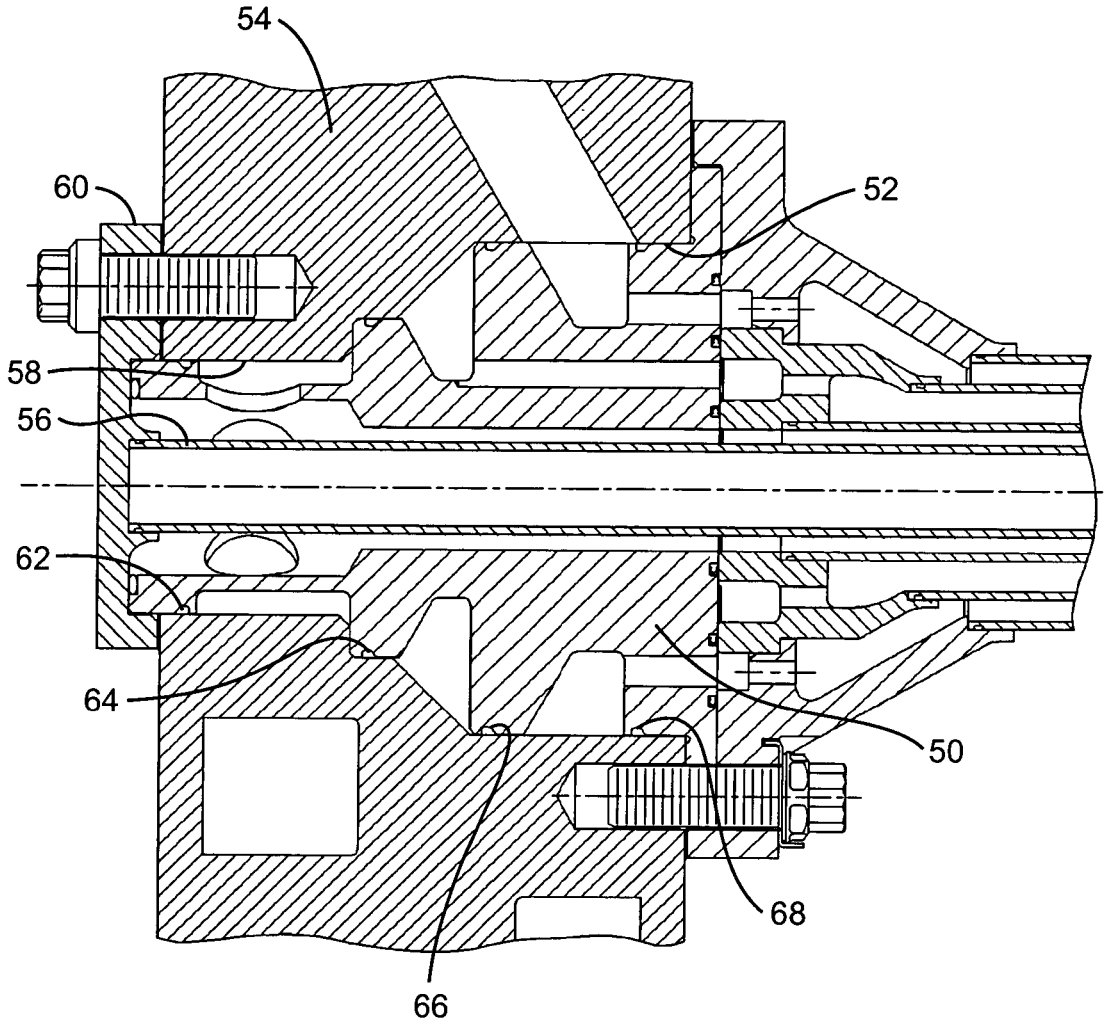
Fig. 2 (Prior Art)
FIG. 2 is a fragmentary enlarged cross-sectional view illustrating an endcover with fuel cartridge and insert brazed to the endcover assembly in accordance with a prior art construction.

Referring to FIG. 2 illustrating an earlier generation of endcover assemblies, similar-type inserts 50 were secured in stepped bores 52 opening through the inside surface of an endcover 54. A fuel cartridge assembly including tube 56 extended through the aperture 58 in the endcover 54 and was closed by a flange 60 bolted to the endcover 54. The insert 50 was brazed to the endcover at discrete locations. For example, brazed joints were applied between the insert and the endcover at 62, 64, 66 and 68. As noted previously, cracking was experienced with respect to these brazed joints, requiring a redesign of the endcover assembly with the fuel nozzles.

Referring to FIGS. 3 and 4, seals are employed in accordance with a preferred embodiment hereof to seal against fluid leakage among the various air and fuel passages in the endcover and insert. The following description refers to the seal between the fuel nozzle cartridge and the endcover which defines the external boundary of the purge passage and prevents fluid leakage out of the endcover assembly into the external environment of the endcover and gas turbine. Seals are also provided between the insert and the endcover to prevent fluid leakage internally into the combustor and those likewise will be discussed following the description of the cartridge/endcover seal.

Referring to FIG. 4, the fuel nozzle cartridge/endcover seal, generally designated 67, includes a seal cover or flange 70 for preventing fluid leakage externally of the endcover 69. Particularly, the aperture 71 through the endcover has a recessed shoulder 72 which receives an annular spring-energized metal, preferably C-shaped seal 74. When the fuel nozzle cartridge is assembled to the endcover 69, the flange 70 biases or crushes against the spring seal 74 to provide primary sealing for the bolted joint between the flange 70 and endcover. It will be appreciated that the legs of the C-shaped seal bear against the axially registering surfaces of the endcover shoulder 72 and an internal annular face of the flange 70 and substantially minimize or eliminate leakage paths past the flange. It will also be appreciated that the flange has sufficient thickness to provide stiffness to prevent bending and subsequent seal unloading. Flange 70 also bears against endcover 69 along annular surfaces radially outwardly of the seal 67. Additionally, as illustrated, the seal 67 also includes an annular relief cut 76 in flange 70 about the perimeter of the seal 67 and radially outwardly of the contacting annular surfaces of the flange and endcover. This cut 76 creates a circular zone that mates with a spot face machined into the nozzle cover. By controlling the surfaces of this zone on the flange and the spot face, a secondary sealing capability is added to the bolted joint.

Further, the seal 74 is provided with a positioning feature. Particularly, the flange 70 includes a cylindrical extension 80 which projects into a bore 82 in the endcover 69. The extension 80, when the flange 70 is bolted to the endcover, closes the seal groove defined by shoulder 72 machined into the endcover. The extension 80 restricts the flow to the seal location, thus affording further protection against leakage. The extension 80 also prevents the introduction of debris into the flowpath in the event of a seal breakdown. By tightly tolerancing the extension 80 in the counterbore, relative motion in a lateral direction between the flange 70 and endcover 69 is precluded or minimized and this, in turn, precludes or minimizes excessive wear of the primary sealing surfaces of the shoulders and the seal itself.

Figure 5:
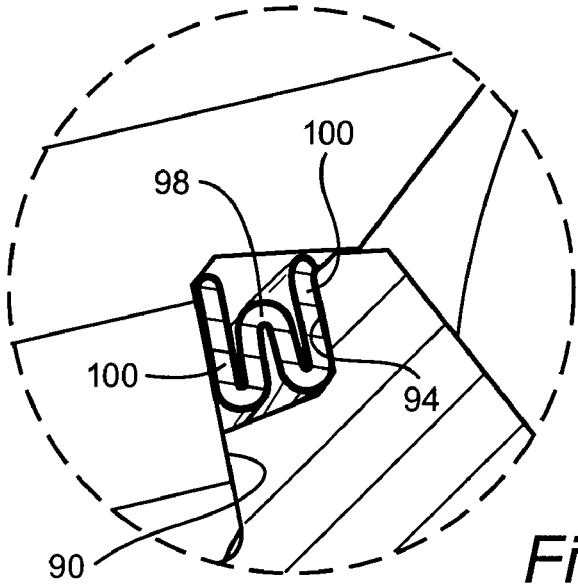
FIG. 5 is a fragmentary enlarged perspective view illustrating one type of seal.

Still referring to FIG. 4, the insert/endcover interface is provided with seals rather than the traditional brazed joints. As illustrated, the insert is received in a stepped bore 40 having shoulders 90 and 92. The insert 38 includes a pair of annular recesses or cavities forming shoulders 94 and 96, respectively. It will be appreciated that when the insert 38 is displaced into the stepped bore, the respective shoulders 90, 94 and 92, 96 will lie in spaced axial registration relative to one another. A seal is provided in each of the respective cavities and preferably comprises an annular metal ring seal 98 having a generally W-shaped cross-section with high spring-back capability. W-shaped seals are desirable since the depth of the cavities change due to thermal expansion and contraction during turbine operation. Consequently, the opposite legs 100 (FIG. 5) of the generally W-shaped seal 98 maintain sealing engagement against the respective shoulders of the cavity throughout the range of thermal deflection. The springs and the cavities are thus dimensioned such that the spring-back capability of the springs ensures a seal under all thermal conditions without over-stressing the spring seal itself.

Figure 6:
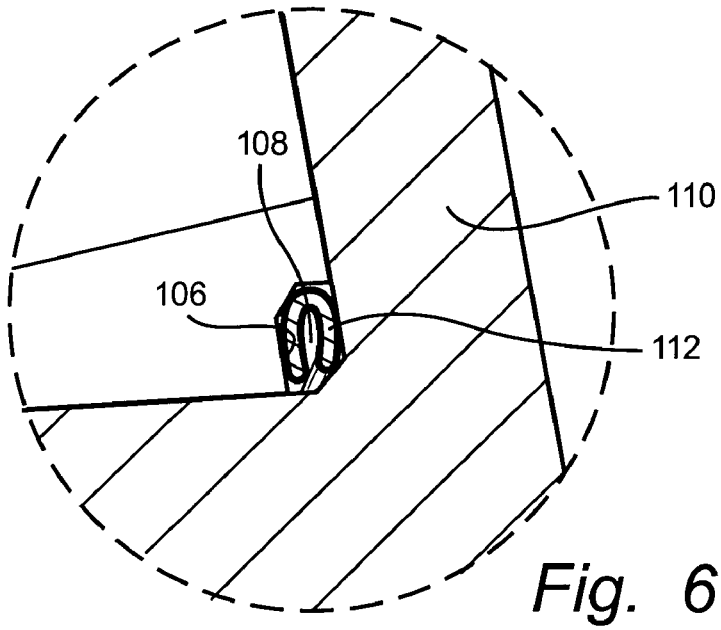
FIG. 6 is a view similar to FIG. 5 illustrating a further type of seal.

Also, as illustrated in FIGS. 4 and 6, the insert 38 is bolted to the interior face of the endcover. About the aperture receiving the insert, there is provided an axially inwardly facing shoulder 106 (relative to endcover 69) forming a cavity 108 with the flange 110 of the insert. An annular seal 112 having a generally C-shaped cross-sectional configuration is located in cavity 108 to maximize sealing between the endcover end face and the end of the insert, which location is minimally impacted by thermal effects. The dimensions of all of the cavities formed between the stepped bore 40 of the endcover 69 and the insert shoulders are also controlled in axial and radial directions to prevent contact between the seals and the endcover or insert during assembly and operation. Moreover, all edges of the cavities are chamfered to avoid seal damage during assembly and operation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An endcover assembly for a combustor of a turbine comprising:

an endcover having an aperture opening through opposite internal and external end faces thereof;

a seal cover secured to the endcover overlying the aperture opening through the external end face of the endcover;

a fuel assembly secured to and projecting internally from said endcover, said fuel assembly including a structure defining a purge passage extending in said aperture;

a seal between said seal cover and said endcover to preclude fluid leakage externally of the endcover assembly from said external face thereof;

said seal including an annular spring generally C-shaped in cross-section having opposite edges biased to engage said seal cover and a seat forming part of said endcover.

2. An assembly according to claim 1 wherein said seat includes an annular recess formed in said external end face of said endcover for receiving a portion of said seal, said seal cover including an annular relief formed in a surface thereof in registration with an annular portion of said endcover about said seal, affording secondary sealing surfaces between the seal cover and the endcover.

3. An assembly according to claim 1 including a counterbore formed in said endcover inwardly of said seal, said seal cover including a cylindrical projection received in and about said counterbore to seal against fluid leakage and restrict relative lateral movement of the seal cover and endcover.

4. An assembly according to claim 1 wherein said aperture through said endcover includes a stepped bore opening through said internal face of said endcover and having a first axial facing shoulder, a stepped insert in said bore having a second shoulder facing in an axial opposite direction and in registration with said first shoulder of said endcover, and at least one annular seal having axially spaced edges engageable against said registering shoulders of said endcover and said insert to seal against internal fluid leakage.

5. An assembly according to claim 4 wherein said one annular seal is generally W-shaped in cross-section.

6. An assembly according to claim 4 wherein said one annular seal is generally C-shaped in cross-section.

7. An assembly according to claim 4 wherein said seal of said endcover bore and said insert has a plurality of axially registering shoulders, and a generally annular spring extending between each of said axially registering shoulders to seal against internal fluid leakage.

8. An assembly according to claim 7 wherein each of said seals are generally W-shaped in cross-section.

9. An assembly according to claim 7 wherein at least one of said springs is generally C-shaped in cross-section and another of said springs is generally W-shaped in cross-section.

10. An assembly according to claim 7 wherein said insert is bolted to the endcover with said bolted joint biasing said seals in an axial direction to form said sealed joints.

11. An endcover assembly for a combustor of a turbine comprising:

an endcover having a stepped bore opening through an internal, axially facing, end face thereof and having a first axially facing shoulder;

said endcover including a plurality of manifolds for conveying fluids;

a stepped insert disposed in said stepped bore and having a second shoulder facing in an opposite axial direction and in registration with said first shoulder of said endcover, said insert having passages in communication with said manifolds, respectively;

a seal between said endcover and said insert having axially spaced legs engageable against said registering shoulders of said endcover and said insert to seal against internal fluid leakage between said endcover and said insert; and a fuel nozzle secured to said endcover and having passageways in communication with the fluid passages, respectively, in said insert.

12. An assembly according to claim 11 wherein said one seal is generally W-shaped in cross-section.

13. An assembly according to claim 11 wherein said one seal is generally C-shaped in cross-section.

14. An assembly according to claim 11 wherein said seal between said endcover bore and said insert includes a plurality of axially registering shoulders, and a generally annular spring extending between each of said axially registering shoulders to seal against internal fluid leakage.

15. An assembly according to claim 14 wherein each of said springs is generally W-shaped in cross-section.

16. An assembly according to claim 14 wherein at least one of said springs is generally C-shaped in cross-section and another of said springs is generally W-shaped in cross-section.

17. An assembly according to claim 14 wherein said insert is bolted to the endcover with the one bolted joint biasing said springs in an axial direction to form said seals.

* * * * *